US005157440A

United States Patent [19]

Sawayama

[11] Patent Number: 5,157,440

[45] Date of Patent: Oct. 20, 1992

[54] TONER DENSITY SENSING DEVICE FOR IMAGE FORMING EQUIPMENT

[75] Inventor: Noboru Sawayama, Tokyo, Japan

[73] Assignee: Ricoh Company, Ltd., Tokyo, Japan

[21] Appl. No.: 742,482

[22] Filed: Aug. 5, 1991

Related U.S. Application Data

[63] Continuation of Ser. No. 551,023, Jul. 11, 1990, abandoned.

[30] Foreign Application Priority Data

Jul. 14, 1989 [JP] Japan ..... 1-180421

[51] Int. Cl.[5] ..... G03G 21/00

[52] U.S. Cl. ..... 355/203; 118/691; 355/208; 355/246

[58] Field of Search ..... 355/203, 208, 246; 118/689, 691, 693, 694; 356/445; 250/571, 572

[56] References Cited

U.S. PATENT DOCUMENTS

| | | | |
|---|---|---|---|
| 4,248,527 | 2/1981 | Akiyama et al. | 355/246 |
| 4,277,162 | 7/1981 | Kasahara et al. | 355/208 |
| 4,313,671 | 2/1982 | Kuru | 355/246 X |
| 4,348,099 | 9/1982 | Fantozzi | 355/208 |
| 4,550,998 | 11/1985 | Nishikawa | 355/246 X |
| 4,551,004 | 11/1985 | Paraskevopoulos | 355/246 X |
| 4,568,835 | 2/1986 | Imamura et al. | 250/572 |
| 4,572,654 | 2/1986 | Murai et al. | 355/246 X |
| 4,647,184 | 3/1987 | Russell et al. | 355/208 |
| 4,786,924 | 11/1987 | Folkins | 355/208 |
| 4,812,665 | 3/1989 | Puumalainen et al. | 250/571 |
| 4,866,481 | 9/1989 | Yamada . | |
| 4,888,636 | 12/1989 | Abe . | |
| 4,951,088 | 8/1990 | Bonvallet et al. | 355/77 |

FOREIGN PATENT DOCUMENTS

| | | | |
|---|---|---|---|
| 0142772 | 6/1989 | Japan | 355/246 |

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

A device incorporated in image forming equipment for sensing the density of a reference toner image formed on a photoconductive element by illuminating the toner image by light issuing from a light emitting element, and causing the light reflected from or transmitted through the toner image to reach a light-sensitive element whose output is representative of the amount of incident light. The device has a first and a second restricting arrangements for intercepting a part of the light issuing from the light emitting element and a part of the light directed toward the light-sensitive element, respectively. The first and second restricting arrangements each has a restriction close to the associated light emitting or light-sensitive element and a restriction remote from the same. In each restricting arrangement, the restriction close to the light emitting or light-sensitive element has a smaller diameter than the restriction remote from the same.

12 Claims, 6 Drawing Sheets

TONER DENSITY SENSING DEVICE FOR IMAGE FORMING EQUIPMENT

This application is a Continuation of application Ser. No. 07/551,023, filed on Jul. 11, 1990, now abandoned.

BACKGROUND OF THE INVENTION

The present invention relates to a device incorporated in image forming equipment for sensing the density of a toner image formed on an image carrier.

Image forming equipment of the type electrostatically forming a latent image on an image carrier and developing it by a mixture of carrier and toner, i.e., two-component type developer is extensively used and implemented as an electronic copier, printer or facsimile machine, for example. In this type of equipment, as the ratio of the toner to the carrier or toner concentration sequentially decreases, the density of the resulting toner image is lowered to degrade the image quality. To maintain the image quality constant, it is a common practice to form a latent image representative of a reference density pattern having a reference density on an image carrier and to develop it to produce a reference toner image. A density sensing device senses the density of the reference toner image. When the sensed density of the reference toner image is low, a fresh toner is supplied to the developer to maintain the toner concentration constant. The density sensing device may be implented with a light emitting element and a light-sensitive element, as well known in the art. Specifically, while the light emitting element illuminates the reference toner image formed on the image carrier, the light-sensitive element generates an output representative of the amount of light reflected from or transmitted through the toner image and incident thereto. Such a conventional device is operable satisfactorily so long as the reference toner image is formed by a black toner. However, when use is made of a color toner, the reference toner image irregularly reflects most of the light incident thereto from the light emitting element, resulting in the decrease in the sensitivity of the device. This, coupled with the irregularity or scattering in output among individual density sensity devices, prevents the density of the reference toner image from being accurately sensed.

In the light of the above, at least one of the light emitting and light-sensitive elements may be provided with a restriction, as disclosed in Japanese Utility Model Laid-open Publication No. 162253/1980 by way of example. The restriction interceps a part of the light issuing from the light emitting element or a part of the light directed toward the light-sensitive element to thereby reduce the amount of irregular reflection incident to the light-sensitive element from the reference toner image. With this scheme, it is possible to enhance the sensitivity of the device and sensing accuracy. However, simply providing the light emitting or light-sensitive element with a restriction cannot cope with positioning errors particular to such elements. Specifically, should the light emitting or light-sensitive element not be accurately positioned relative to the image forming equipment, the sensing accuracy would differ from one density sensing device to another. This obstructs accurate sensing of the density of the reference toner image.

SUMMARY OF THE INVENTION

It is therefore an object of the present invention to provide a toner image density sensing device for image forming equipment which has high sensitivity and high sensing accuracy despite a simple construction thereof.

It is another object of the present invention to provide a toner image density sensing device for image forming equipment which maintains high sensing accuracy despite the positioning errors of a light emitting and a light-sensitive element.

It is another object of the present invention to provide a generally improved toner image density sensing device for image forming equipment.

In accordance with the present invention, a device for sensing density of a toner image formed on an image carrier of image forming equipment comprises a light emitting element for emitting light to illuminate a reference toner image formed on the image carrier, a light-sensitive element for generating an output representative of an amount of light which is incident thereto from the reference toner image, and at least one of a first restriction arrangement for intercepting a part of the light issuing from the light emitting element, and a second restriction arrangement for intercepting a part of the light directed toward the light-sensitive element. At least one of the restriction arrangements comprising a first restriction located in close proximity to the light-emitting element or the light-sensitive element, and a second restriction spaced apart from the first restriction.

Also, in accordance with the present invention, a device for sensing density of a toner image formed on an image carrier of image forming equipment comprises a light emitting element comprising a light emitting body for emitting light and a convex lens for transmitting the light from the light emitting body toward a reference toner image which is formed on the image carrier, a restriction for intercepting a part of the light issuing from the convex lens, and a light-sensitive element for generating an output representative of an amount of light which is incident thereto from the reference toner image. The convex lens of the light emitting element has a smaller diameter than the restriction.

Further, in accordance with the present invention, a device for sensing density of a toner image formed on an image carrier of image forming equipment comprises a light emitting element for emitting light to illuminate a reference toner image formed on the image carrier, a light-sensitive element comprising a convex lens for transmitting light from the refrence toner image and a light-sensitive body to which the light transmitted through the convex lens is incident, and generating an output representative of an amount of light incident to the light-sensitive body, and a restriction for intercepting a part of the light directed toward the light-sensitive body. The convex lens of the light-sensitive element has a smaller diameter than the restriction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
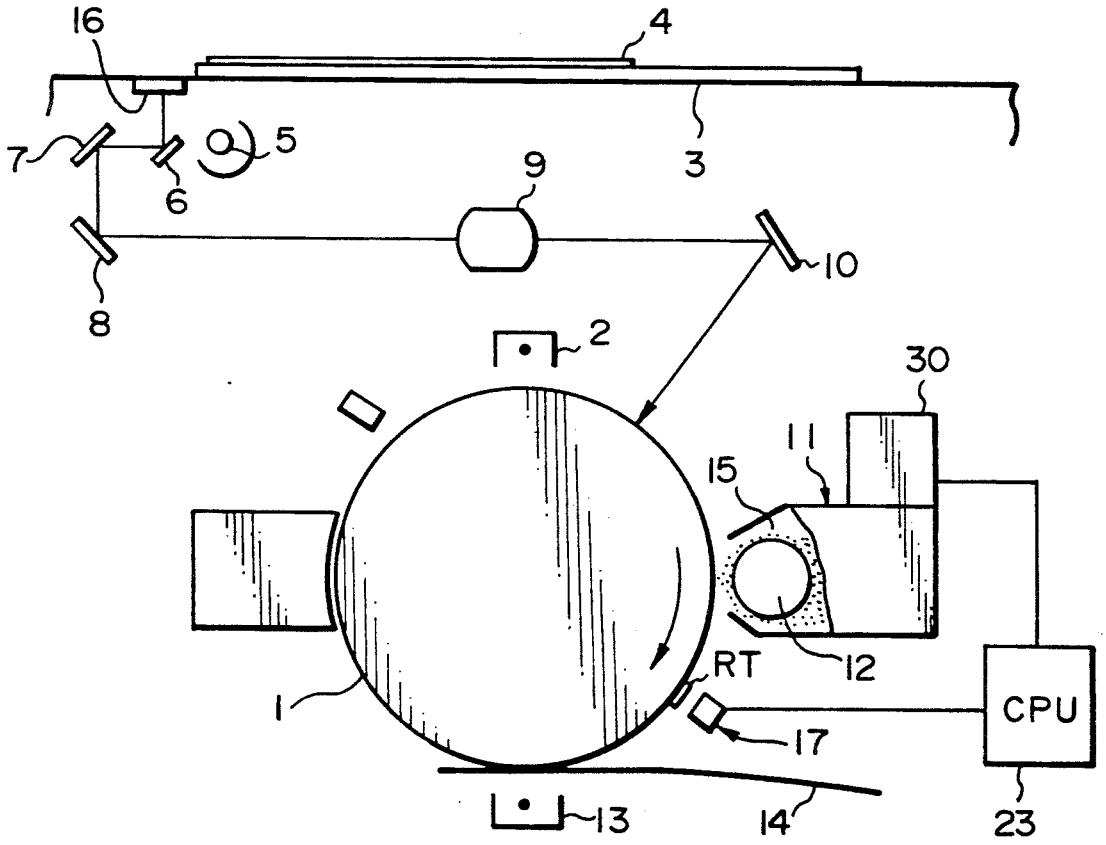
FIG. 1 is a section schematically showing an analog electronic copier which is a specific form of image forming equipment.

To better understand the present invention, a brief reference will be made to an analog electrophotographic copier which belongs to a family of image forming equipment, shown in FIG. 1. As shown, the copier has an image carrier in the form of a photoconductive drum 1 which is rotatable clockwise as viewed in the figure. A main charger 2 uniformly charges the surface of the drum 1 to predetermined polarity. A transparent glass platen 3 is disposed above the drum 1 and loaded with a document 4. A light source 5 is movable from the left to the right as viewed in the figure so as to illuminate the document 4. A reflection or imagewise light from the document 4 is sequentially reflected by a first mirror 6 which moves together with the light source 5, and a second and a third mirror 7 and 8 which move in the same direction as the light source 5. Then, the imagewise light is routed through a lens 9 and a stationary fourth mirror 10 to the charged surface of the drum 1, whereby a latent image representative of the document 4 is electrostatically formed on the drum 1. A developing unit 11 has a developing roller 12 and is loaded with a two-component type developer 15, i.e. a mixture of toner and carrier. The latent image is developed by the toner which is deposited on the developing roller 12, and the resulting toner image is transferred to a paper sheet 14 by a transfer charger 13.

As the copying operation stated above is repeated, the ratio of the toner to the carrier in the developer 15 is lowered and, in due course, the density of the toner image is lowered to degrade the image quality. To eliminate this occurence, a reference density pattern 16 having a density of 1.8, for example, is positioned in the vicinity of the glass platen 3. While light issuing from the light source 5 illuminates the pattern 16, a reflection therefrom is steered by the optics 6, 7, 8, 9 and 10 to the drum 1 to form a reference latent image having a predetermined surface potential. The developing unit 11 turns the reference latent image to a toner image, or reference toner image, RT. A density detecting device 17 to which the present invention pertains detects the density of the reference toner image RT. When the density of the reference toner image RT is lower than a predetermined value as determined on the basis of the output of the device 17, a fresh toner is fed from a toner container 30 into the developer of the developing unit 11 so as to prevent the density of the toner image from being lowered. Such detection may be effected every time an ordinary copying operation is completed or every time it is repeated a certain number of times.

Figure 2:
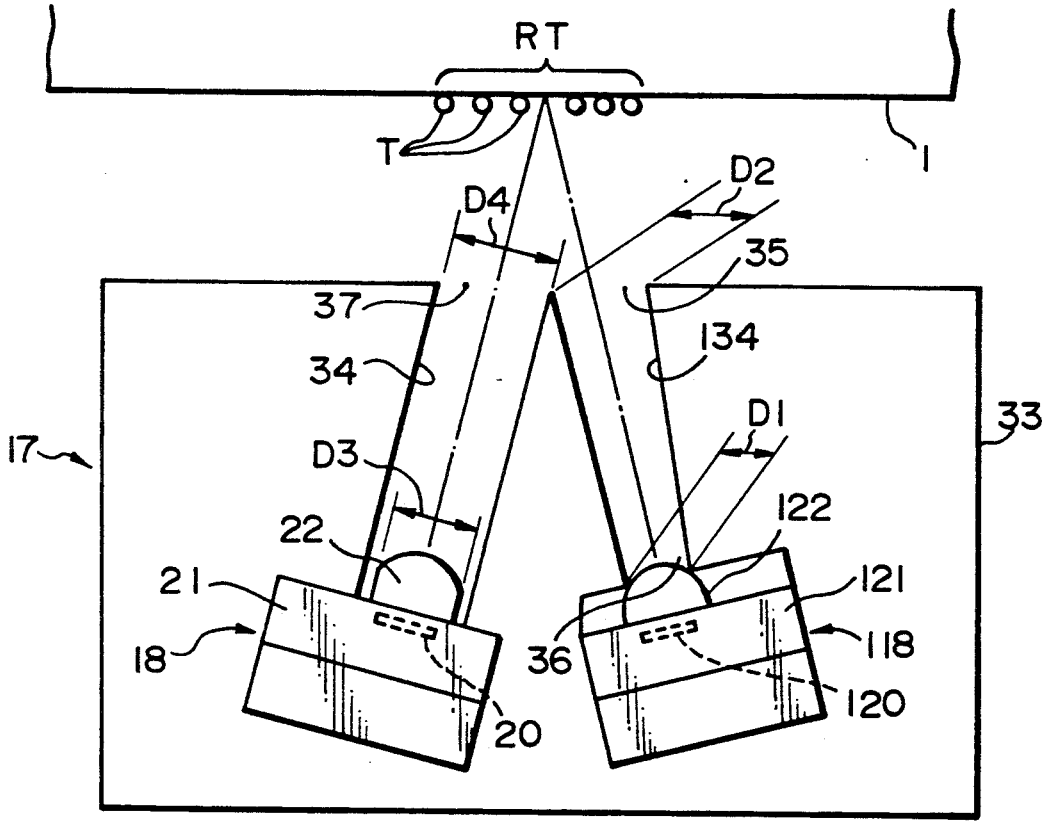
FIG. 2 is an enlarged view showing a density sensing device embodying the present invention.

Referring to FIG. 2, a density sensing device embodying the present invention is shown and generally implemented as a reflection type sensor. Specifically, the density sensing device, generally 17, has a light emitting element 18 and a light-sensitive element 118. In the illustrative embodiment, the light emitting element 18 has a light emitting diode (LED) or similar light emitting body 20, a support 21 supporting the LED 20 and made of transparent resin, and a convex lens 22 constituted by a part of the transparent support 21. Likewise, the light-sensitive element 118 has a phototransistor or similar light-sensitive body 120, a support 121 supporting the phototransistor 120 and make of transparent resin, and a convex lens 122 constituted by a part of the transparent support 121. Light issuing from the LED 20 of the LED 18 via the convex lens 22 illuminates the reference toner image RT formed on the drum 1. A reflection from the reference toner image RT is incident to the phototransistor 120 of the light-sensitive element 118 via the convex lens 122. In response, the phototransistor 120 produces an output signal representative of the quantity of the incident light and delivers it to a CPU 23, FIG. 1. When the CPU 23 determines that the toner concentration of the developer 15 is low, a fresh toner is supplied, as stated earlier. In FIG. 2, the toner forming the reference toner image RT is generally labeled T.

When the density of the reference toner image RT is high, a large amount of light is absorbed by the toner with the result that the amount of light incident to the light-sensitive element 118 is reduced. Conversely, as the concentration of the toner in the developer 15 and, therefore, the density of the image RT decreases, the amount of light which is reflected by the area of the drum 1 where no toner exists increases. Then, the amount of light incident to the light-sensitive element 118 is increased to in turn increase the output of the element 118. Assume that the light-sensitive element 118 produces an output Vsg. (4.0 volts or so in practice) in response to a reflection from the surface of the drum 1 where no toner exists. Also, assume that the light-sensitive element 118 produces an output Vsp in response to a reflection from the reference toner image RT. Generally, when use is made of a black toner, it is determined that the density of the image RT is low if the ratio Vsp/Vsg is greater than one/eighth, and a fresh toner is supplied. This is successful in controlling the amount of toner to be deposited on the reference toner image RT to about 0.4 milligrams per square centimeter and, therefore, in maintaining the density of ordinary toner images substantially constant.

It is to be noted that when the drum 1 has a photoconductive layer implemented with selenium, the light-sensitive element 118 is responsive to light whose wavelength has a peak lying in the range of 900 to 950 nanometers.

Figure 4:
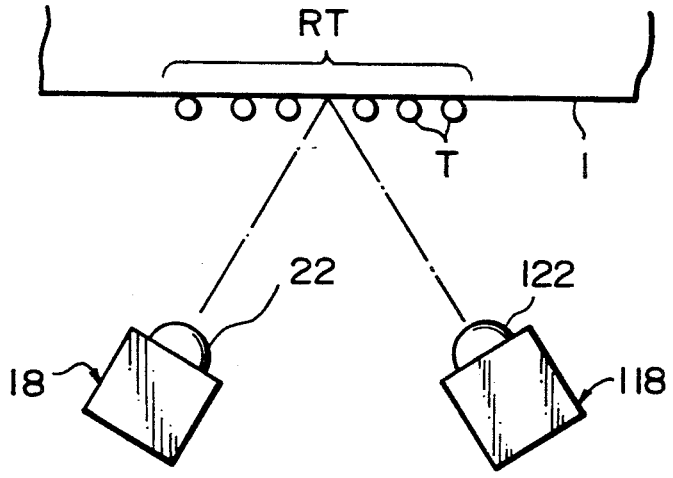
FIG. 4 PRIOR ART

The construction and operation described so far are conventional. Drawbacks particular to a prior art density sensing device will be described specifically, prior to the characteristic features of the illustrative embodiment. FIG. 4 shows a specific arrangement of a prior art density detecting device. The device shown in FIG. 4 is constructed and operated in the same manner as the device described with reference to FIG. 2, and the same components are designated by like reference numerals.

Assume that the developing unit 11, FIG. 1, is loaded with a developer containing a black toner. Then, as shown in FIG. 4, the reference toner image RT is formed by the black toner T, so that most of the light issued from the light emitting element 18 and incident to the toner T is absorbed by the toner T. Concerning the drum 1 of the analog copier as with the illustrative embodiment, light incident to its area where the toner T is not deposited is almost entirely regularly reflected and incident to the light-sensitive element 118. In this condition, the amount of toner deposited on the reference toner image RT and the output of the light-sensitive element 118 are related as represented by a curve A in FIG. 3A. Specifically, when no toner is deposited on the drum 1, the light-sensitive element 118 produces the output Vsg; the output sequentially decreases with the increase in the amount of toner deposition. The prior art density sensing device is, therefore, capable of sensing the density of the reference toner image RT satisfactorily so long as the toner is a black toner.

On the other hand, assume that the developing unit 11, FIG. 1, uses a color toner and, therefore, the reference toner image RT, FIG. 4, is formed by the color toner T. Light incident to the color toner T is almost entirely irregularly reflected, i.e., only about 10 to 30 percent of the incident light is absorbed by the color toner. The irregularly reflected light is scattered around in various directions and is partly incident to the light-sensitive element 118. Most of the light incident to the area of the drum 1 where no color toner T exists is regularly reflected and incident to the light-sensitive element 118, as with the black toner. As a greater amount of color toner T is deposited, more of the light is irregularly reflected with the result that the ratio of the irregular reflection to the regular reflection in the total quantity of reflection from the reference toner image RT is increased.

Figure 3A:
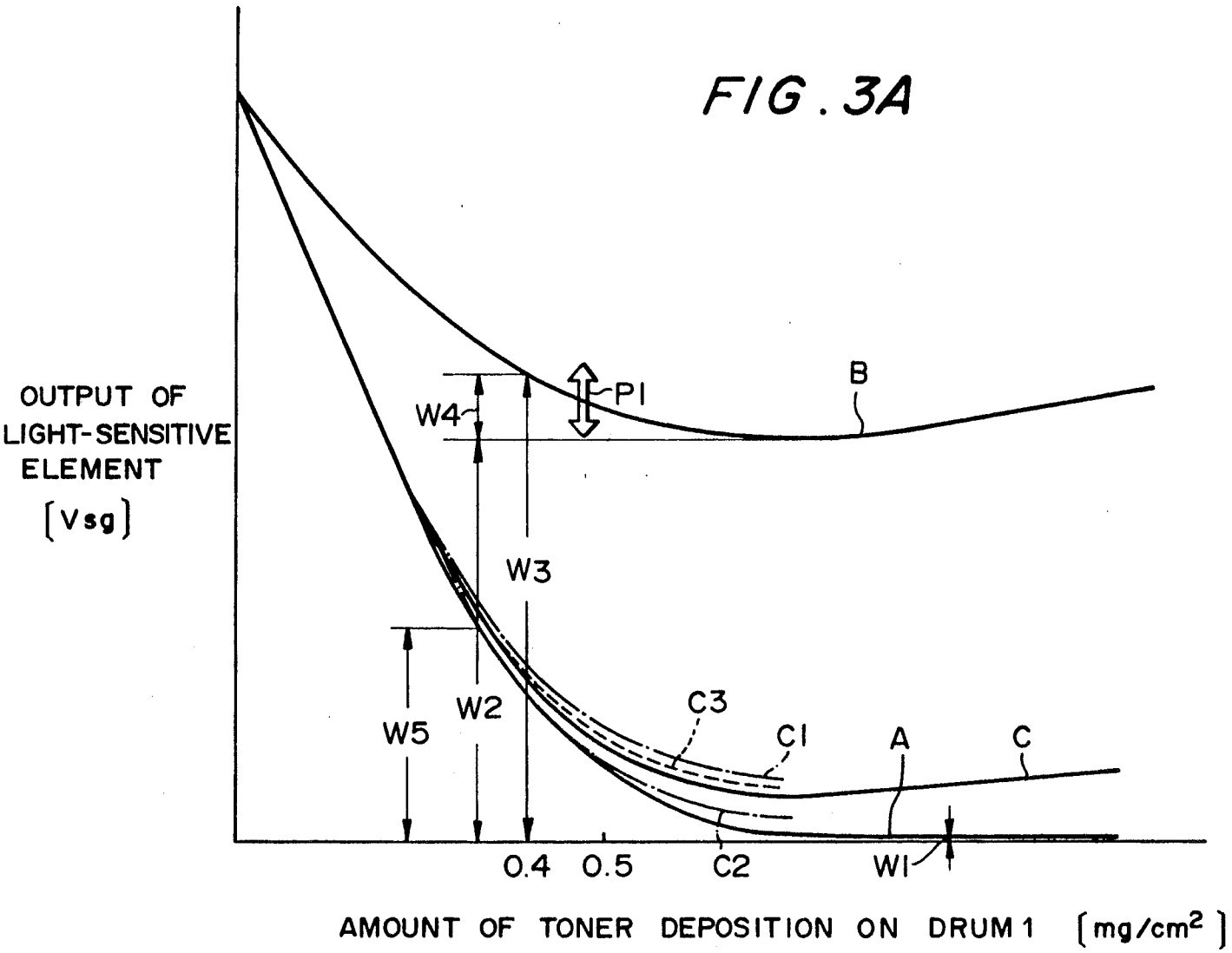
FIGS. 3A and 3B are graphs each showing a relation between the amount of toner deposition on a photoconductive element, or image carrier, and the output of a light-sensitive element.

In FIG. 3A, a curve B is representative of a relation between the amount of toner deposition on the drum 1 and the amount of light incident to the light-sensitive element 118, i.e., the output of the element 118 which is ascribable to the irregular reflection by the color toner T. Specifically, in the case of a black toner, most of the light incident to the toner is absorbed by the toner and, therefore, the output of the element 118 sharply lowers with the increase in the amount of toner deposition on the drum, as indicated by the curve A. In contrast, in the case of a color toner, most of the light incident to the toner is irregularly reflected by the latter and, hence, the output of the element 118 lowers slowly despite the increase in the amount of toner deposition, as indicated by the curve B. As a result, when use is made of a color toner, the output of the element 118 changes little relative to the change in the amount of toner deposition, i.e., the sensitivity of the element 118 is critically degraded to obstruct accurate density detection.

Another problem with the use of a color toner is as follows. Assume that a regular reflection from the drum 1 is L1 when the toner is not deposited thereon at all, and that an irregular reflection from the drum 1 is L2 when the drum 1 is entirely covered with the toner. Let the ratio L1/L2 be referred to as an S/N ratio hereinafter. Concerning the drum 1 installed in the analog copier shown in FIG. 1, the S/N ratio is about 15 when a black toner is used and about 1.3 when a color toner is used. Specifically, while the S/N ratio particular to the black toner is great because the black toner absorbs most of the light, the S/N ratio particular to the color toner is as small as about one-tenth the black toner because it reflects most of the light irregularly. Describing this in relation to the curves A and B of FIG. 3A, the black toner absorbs most of the incident light and the light incident to the light-sensitive element 118 includes hardly any irregular reflection, so that the minimum output W1 of the element 118 is considerably low. In the case of the color toner, since a part of the reflection therefrom is incident to the light-sensitive element 118, the minimum output W2 of the element 118 is not significantly lowered even though the amount of toner deposition may increase. The minimum value W2 is the output corresponding to the light irregularly reflected by the color toner and incident to the element 118. Specifically, assuming that the amount of toner deposition is 0.4 milligrams per square centimeter, only a part W4 of the total output W3 of the element 118 is representative of the regular reflection incident to the element 118, while the rest W2 is representative of the irregular reflection incident to the element 118. In this manner, the proportion of the irregular reflection is increased. Concerning the black toner, most of the output W5 of the element 118 is representative of the regular reflection.

As stated above, when use is made of a color toner, the S/N ratio is so small that the ratio between the irregular reflection incident to the light-sensitive element 118 and the regular reflection changes when, for example, the directivity of light differs even a little from one light emitting element 18 to another due to scattering particular to the production line. This means that the curve B, FIG. 3A, shifts as indicated by a double-headed arrow P1, depending on the density sensing device. Therefore, it is not practicable with the prior art to sense the density of the reference tone density with accuracy.

Figure 5A:
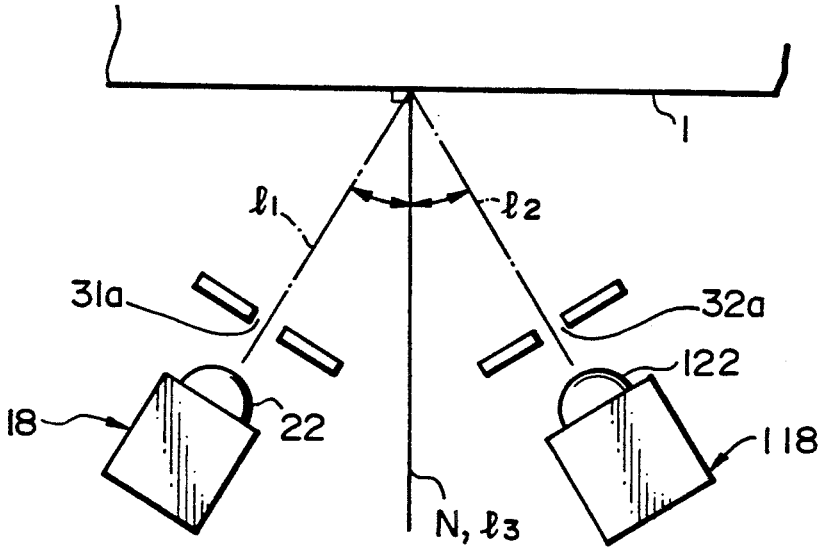
FIG. 5A PRIOR ART
FIGS. 5A and 5B views showing prior art density sensing devices and useful for understanding drawbacks thereof.

In the light of this, as shown in FIG. 5A, at least one of the light emitting element 18 and light-sensitive element 118 may be provided with a restriction 31*a* or 32*a*. Such a scheme is disclosed in Japanese Utility Model Laid-Open Publication No. 162253/1980 mentioned previously. The restriction 31*a* or 32*a* intercepts a part of the light issuing from the light emitting element 18 or the light directed toward the light-sensitive element 118, whereby 80 percent or so of the irregular reflection from the color toner is cut. With the restriction 31*a* or 32*a*, it is possible to reduce the ratio of the irregular reflection to the total amount of light incident to the element 118 and thereby to increase the proportion of the regular reflection. Hence, the relation between the amount of toner deposition on the drum 1 and the output of the element 118 particular to a color toner can be corrected, as represented by a curve C in FIG. 3A. As a result, the sensitivity of the device is enhanced and, in addition, the scattering in the ratio between the regular and irregular reflections ascribable to the scattering in the directivity of light issuing from the element 18 is reduced to promote accurate sensing. When a black toner is used, the output of the element 118 substantially follows the curve A despite the restriction 31*a* or 32*a* because hardly any irregular reflection is incident to the element 118.

However, simply providing the restrictions 31*a* and 32*a* cannot eliminate the fear of scattering and the effect on sensing accuracy among the devices due to the scattering in the positioning accuracy of the light emitting element 18 and light-sensitive element 118. Specifically, as shown in FIG. 5A, so long as a line l3 bisecting the angle between the optical axes l1 and l2 of the lenses 22 and 122, respectively, is coincident with a normal N to the surface of the drum 1, the restrictions 31*a* and 32*a* alone will allow the device to sense the density of the reference toner image accurately.

Figure 5B:
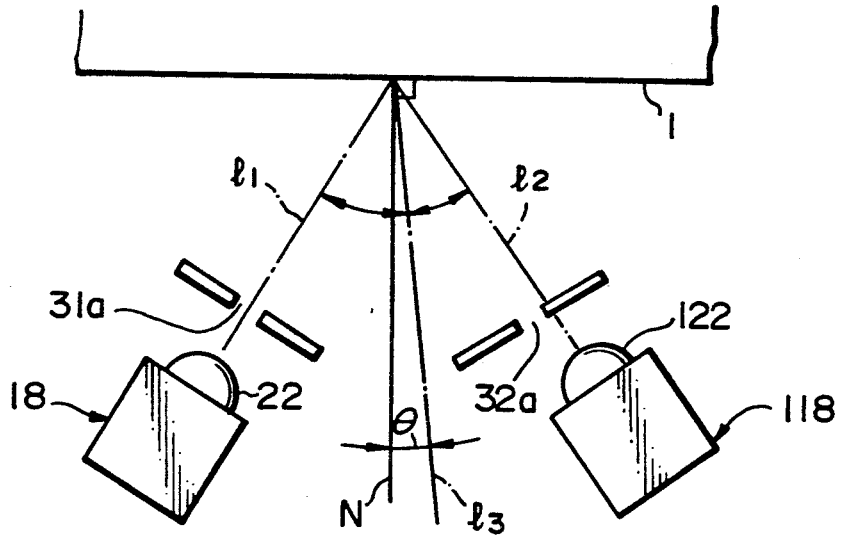
FIG. 5B PRIOR ART

As shown in FIG. 5B, assume that the light emitting element 18 and/or the light-sensitive element 118 is slightly inclined relative to the position shown in FIG. 5A due to inaccurate positioning. In this condition, the bisecting line l3 is not coincident with the normal N and is inclined by an angle $\theta$ to the latter. Then, the regular reflection from the area of the drum 1 where the reference toner image is formed will be prevented by the restriction 32*a* from reaching the light-sensitive element 118. Experiments showed that the regular reflection is cut by about 20 percent when the angle $\theta$ is 2 degrees and by about 50 percent when it is 4 degrees. Usually, the inclination angle $\theta$ of about 2 degrees necessarily occurs in the actual production line. Should the positioning accuracy be different from one device to another as stated above, the curve C shown in FIG. 3A would shift in the range between dash-and-dot curves C1 and C2 and thereby prevent the individual devices from sensing the density of the reference toner image with the same accuracy.

In the illustrative embodiment, as shown in FIG. 2, the light emitting element 18 and light-sensitive element 118 are affixed to a common casing 33. The casing 33 has bores 34 and 134 for defining optical paths which terminate at the convex lenses 22 and 122, respectively. The upper and lower apertures of the bore 134 associated with the light-sensitive element 118 serve as restrictions 35 and 36, respectively. The restrictions 35 and 36 constitute restricting means in combination. Concerning the basic function, the restrictions 35 and 36 are the same as the restriction shown in FIG. 5A and enhance the sensitivity of the device and accurate sensing. The difference is that the light-sensitive element 118 is provided with two such restrictions 35 and 36. Another difference is that the restriction 36 close to the element 118 has a diameter D1 which is smaller than the diameter D2 of the restriction 35 remote from the element 118.

With the above configuration, the bore 134 is flared from the bottom toward the top. Hence, even when the light emitting element 18 and/or the light-sensitive element is not accurately positioned as shown in FIG. 5B, the occurrence that a regular reflection from the drum 1 is cut by a restriction is eliminated. More specifically, if the inclination angle $\theta$, FIG. 5, is confined in the range of $\pm 2$ degrees, the regular reflection is successfully prevented from being cut. When the angle $\theta$ is 4 degrees, 20 percent of a regular reflection will be cut by the restrictions 35 and 36. It follows that the curve C, FIG. 3A, is prevented from shifting between the curves C1 and C2, i.e., the individual devices shares the same sensing accuracy. Since the restriction 36 has a larger diameter than the prior art restriction, the amount of irregular reflection from the reference toner image which is incident to the light-sensitive element 118 will slightly increase and, therefore, the output of the element 118 and the amount of toner deposition will be related as represented by a dashed curve C3 in FIG. 3A. Although the curve C3 means slightly lower sensitivity than the curve C available with the prior art restriction, the curve C3 differs little from one device to another and, therefore, insures accurate sensing of the density of the reference toner image. Stated another way, the ratio between the regular reflection component and the irregular reflection component of the light incident to the element 118 is maintained constant, so that a sensing device with a minimum of scattering can be produced although the sensitivity may be slightly low.

Let the configuration described above be referred to as a first configuration for simplicity. Then, the first configuration is also applicable to the light-emitting element 18. Specifically, restricting means comprising two restrictions may be associated with the element 18 for intercepting a part of the light issuing from the element 18, and the diameter D1 of one restriction close to the element 18 may be selected to be smaller than the diameter D2 of the other restriction remote from the element 18. If desired, the first configuration may be applied to both of the elements 18 and 118. The gist is that the first configuration is practicable with at least either one of the elements 18 and 118.

Further, the first configuration stated above is practicable even when the light emitting element 18 and light-sensitive element 18 lack their convex lenses 22 and 122.

In the embodiment shown in FIG. 2, the bore 34 associated with the light emitting element 18 forms a restriction 37 so that the light issuing from the LED 20 may be partly intercepted by the restriction 37. Basically, the restriction 37 functions in the same manner as the restriction 31*a*, FIG. 5A. The difference is that the restriction 37 has a diameter D4 larger than the diameter D3 of the convex lens 22. This configuration will be referred to as a second configuration hereinafter. In the second configuration, since the diameter D4 of the restriction 37 is larger than the diameter D3 of the lens 22 from which light emanates, the cut of light as shown in FIG. 5B is eliminated. Hence, the second configuration achieves entirely the same advantages as the first configuration, i.e., the output of the light emitting element 18 represented by the curve C3, FIG. 3A, is maintained.

The second configuration may also be associated with the light-sensitive element 118 or even with both of the elements 18 and 118. While the first and second configurations each is practicable with one or both of the elements 18 and 118 as stated, the second configuration should be accompanied by the convex lens 22 and/or the convex lens 122.

Although the foregoing description has concentrated on an analog electrophotographic copier, the present invention is more advantageously applicable to digital image forming equipment such as a digital copier, as follows.

In a digital copier, a laser beam selectively scans the uniformly charged surface of a photoconductive element in response to an image signal and thereby electrostatically forms a latent image thereon. The latent image is developed by a toner. When use is made of a two-component developer, a fresh toner has to be supplied to the developer from time to time in exactly the same manner as with the copier shown in FIG. 1. It has been customary to illuminate the surface of the photoconductive element by a predetermined amount of laser beam to form a reference latent image. The reference latent image is developed by a toner to form a reference toner image, and a density sensing device senses the density of the reference toner image. When the density of the reference toner image is low, a fresh toner is supplied to the developer. Basically, therefore, the digital copier shares the same toner density sensing principle with the analog copier.

The photocoductive element incorporated in a digital copier has a irregular reflection layer between the surface or the base and the photoconductive layer thereof in order to eliminate regular reflection. This is a countermeasure against interference fringe otherwise caused by multipath reflection in the photoconductive layer. Hence, when the surface of the photoconductive element is illuminated, the amount of regular reflection is extremely small. For example, only 5 percent of the light incident to the photoconductive element is regularly reflected, 40 percent is irregularly reflected, and the rest is absorbed. In contrast, the photoconductive element 1 incorporated in an analog copier reflects most of the light, e.g., more than 80 percent of the light regularly, as stated earlier.

Figure 3B:
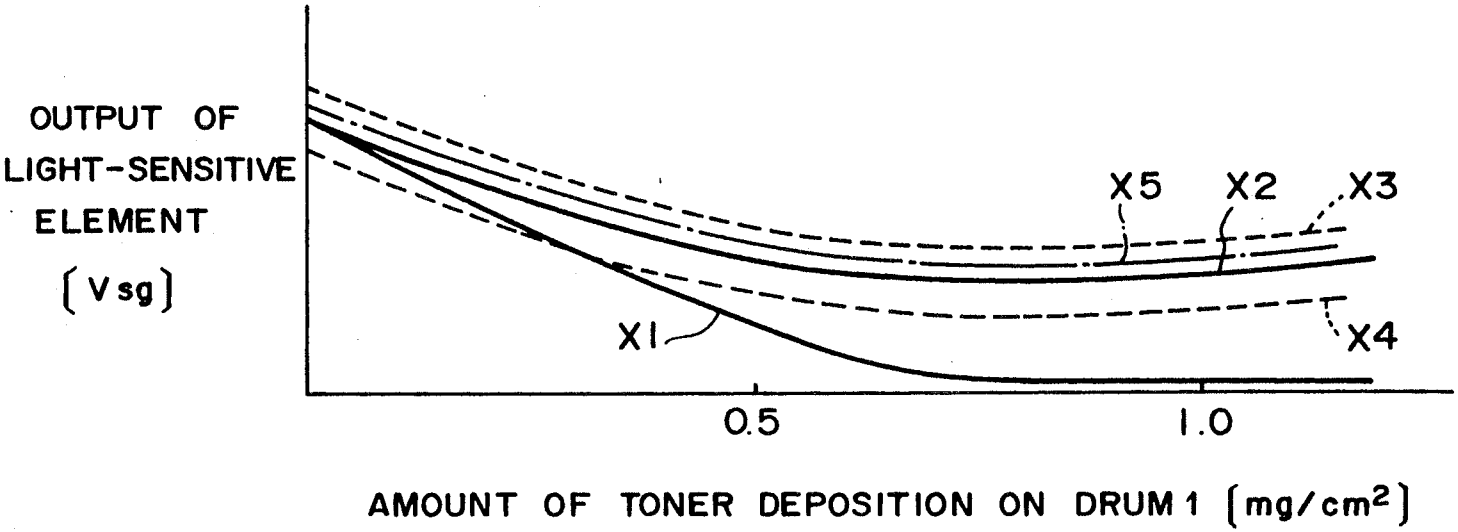

The S/N ratio achievable with the photoconductive element of a digital copier is as low as 1.1 for black toner and 0.11 for a color toner because the element reflects a majority of the incident light irregularly. As a result, the drawback discussed with reference to FIG. 4 is more pronounced. In this respect, the restrictions 31*a* and 32*a* shown in FIG. 5A are advantageously applicable to a digital copier also. In FIG. 3B, curves X1 and X2 each is indicative of a relation between the output of a light-sensitive element and the amount of toner deposition as determined by using the restrictions 31*a* and 32*a* and by causing a reflection from the photoconductive element of a digital copier to be incident to the light sensitive element. The curves X1 and X2 were attained with a black toner and a color toner, respectively.

Again, assuming that the light emitting element and/or the light-sensitive element is not accurately positioned as shown in FIG. 5B, the curve X2, FIG. 3B, shifts in the range between dashed curves X3 and X4. When the configuration shown in FIG. 2 is applied to the density sensing device of the digital copier, the output of the light-sensitive element is substantially fixed as represented by a dashed curve X5, FIG. 3B, when use is made of a color toner. This is successful in eliminating the scattering in sensing accuracy among individual sensing device. Of course, the function particular to restrictions is achievable as with the prior art.

The illustrative embodiment has been shown and described in relation to a construction of the type using a photoconductive element as an image carrier for forming a reference toner image, i.e., forming a reference toner image on a photoconductive element and sensing the density thereof. The present invention is similarly applicable to another type of conventional image forming equipment which forms a toner image on a photoconductive element by an ordinary copying operation and transfers it to a paper sheet laid on a transparent transfer belt. In this type of equipment, a light emitting and a light-sensitive element are positioned at opposite sides of the transfer belt. After a reference toner image has been transferred from the photoconductive element to the transfer belt, the light emitting element emits light toward the reference toner image while the light-sensitive element is sensitive to a part of the light having been transmitted through the area of the belt where the image exists. This type of sensor is generally referred to as a transmission type sensor. The present invention is successfully practicable even with an image carrier implemented as a transfer belt, as stated above.

In summary, it will be seen that the present invention provides a density sensing device which has high sensitivity and sensing accuracy, especially when use is made of a color toner, and effectively reduces the scattering in sensing accuracy ascribable to inaccurate positioning of a light emitting and a light-sensitive element.

Various modifications will become possible for those skilled in the art after receiving the teachings of the present disclosure without departing from the scope thereof.

What is claimed is:

1. A device for sensing density of a toner image formed on an image carrier of image forming equipment comprising:

a light emitting element for emitting light to illuminate a reference toner image formed on the image carrier;

a light-sensitive element for generating an output representative of an amount of light which is incident thereto from the reference toner image;

a first restricting means which defines a first bore for intercepting a part of the light issuing from said light emitting element; and a second restricting means which defines a second bore for intercepting part of the light directed toward said light-sensitive element;

at least one of said first and second bores of said first and second restricting means continuously tapering in an outward direction from a first position adjacent to said light-emitting element or said light sensitive element to a second position spaced apart from said first position, wherein a diameter of said at least one bore at said first position is smaller than a diameter of said bore at said second position.

2. A device as claimed in claim 1, further comprising a first convex lens located at said first position adjacent to said light emitting element for transmitting light from said light emitting element toward said reference toner image formed on the image carrier, and a second convex lens located at said first position adjacent to said light-sensitive element for transmitting light from said reference toner image to said light-sensitive element.

3. A device as claimed in claim 2, wherein a diameter of said first convex lens is smaller than the diameter of said first bore at said second position.

4. A device as claimed in claim 2, wherein a diameter of said first convex lens is greater than the diameter of said first bore at said first position.

5. A device as claimed in claim 2, wherein a diameter of said second convex lens is smaller than the diameter of said second bore at said second position.

6. A device as claimed in claim 2, wherein a diameter of said second convex lens is greater than the diameter of said second bore at said first position.

7. A device for sensing density of a toner image formed on an image carrier of image forming equipment comprising:

a light emitting element for emitting light to illuminate a reference toner image formed on the image carrier;

light-sensitive element for generating an output representative of an amount of light which is incident thereto from the reference toner image;

emitted light restricting means for intercepting a part of the light issuing from said light emitting element, said emitted light restricting means comprising a first restriction located in close proximity to said light emitting element and a second restriction spaced apart from said first restriction; and incident light restricting means for intercepting a part of the light directed toward said light-sensitive element, said incident light restricting means comprising a first restriction located in close proximity to said light-sensitive element and a second restriction spaced from said first restriction;

wherein a diameter of said first restriction of said emitted light restricting means is smaller than a diameter of said second restriction of said emitted light restricting means, and a diameter of said first restriction of said incident light restricting means is smaller than a diameter of said second restriction of said incident light restricting means;

said device further comprising:

a first convex lens defining said first restriction of said emitted light restricting means for transmitting light from said light emitting element toward said reference toner image formed on the image carrier; and a second convex lens located adjacent to said first restriction of said incident light restricting means for transmitting light from said reference toner image to said light-sensitive element.

8. A device as claimed in claim 7, wherein a diameter of said first convex lens is smaller than a diameter of said second restriction of said emitted light restricting means.

9. A device as claimed in claim 7, wherein a diameter of said first convex lens is greater than a diameter of said first restriction of said emitted light restricting means.

10. A device as claimed in claim 7, wherein a diameter of said second convex lens is smaller than a diameter of said second restriction of said incident light restricting means.

11. A device as claimed in claim 7, wherein a diameter of said second convex lens is greater than a diameter of said first restriction of said incident light restricting means.

12. A device for sensing density of a toner image formed on an image carrier of image forming equipment comprising:

a light emitting element for emitting light to illuminate a reference toner image formed on the image carrier;

a light-sensitive element for generating an output representative of an amount of light which is incident thereto from the reference toner image;

emitted light restricting means for intercepting a part of the light issuing from said light emitting element, said emitted light restricting means comprising a first restriction located in close proximity to said light emitting element and a second restriction spaced apart from said first restriction; and incident light restricting means for intercepting a part of the light directed toward said light-sensitive element, said incident light restricting means comprising a first restriction located in close proximity to said light-sensitive element and a second restriction spaced from said first restriction;

wherein a diameter of said first restriction of said emitted light restricting means is smaller than a diameter of said second restriction of said emitted light restricting means, and a diameter of said first restriction of said incident light restricting means is smaller than a diameter of said second restriction of said incident light restricting means;

said device further comprising:

a convex lens means located adjacent to said first restriction of said incident light restricting means for transmitting light from said reference toner image to said light-sensitive element.

* * * * *